US008342480B2

(12) United States Patent
Hendrickson et al.

(10) Patent No.: US 8,342,480 B2
(45) Date of Patent: Jan. 1, 2013

(54) SUBSTANCE COMMUNICATING DEVICE WITH MECHANICALLY ENERGIZED CONNECTOR

(75) Inventors: Michael S. Hendrickson, St. Joseph, MI (US); Joel A. Luckman, Benton Harbor, MI (US); Richard A. McCoy, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 384 days.

(21) Appl. No.: 12/643,137

(22) Filed: Dec. 21, 2009

(65) Prior Publication Data

US 2011/0146328 A1 Jun. 23, 2011

(51) Int. Cl.
*F16L 37/28* (2006.01)
*B65B 1/04* (2006.01)

(52) U.S. Cl. ..... 251/149; 141/347; 141/349; 141/351

(58) Field of Classification Search ..... 251/149, 251/142; 141/349, 351, 198, 192, 347
See application file for complete search history.

(56) References Cited

U.S. PATENT DOCUMENTS

| | | | | |
|---|---|---|---|---|
| 1,958,206 | A | | 5/1934 | Rubsam |
| 3,101,984 | A | | 8/1963 | Wieckmann |
| 3,258,553 | A | | 6/1966 | Breslin |
| 4,148,536 | A | | 4/1979 | Petropoulsos et al. |
| 4,591,732 | A | | 5/1986 | Neuenschwander |
| 4,604,505 | A | | 8/1986 | Henninger |
| 5,031,258 | A | * | 7/1991 | Shaw ..... 4/623 |
| 5,385,468 | A | | 1/1995 | Verderber |
| 5,433,623 | A | | 7/1995 | Wakata et al. |
| 5,713,752 | A | | 2/1998 | Leong et al. |
| 6,176,718 | B1 | | 1/2001 | Skarie et al. |
| 6,350,148 | B1 | | 2/2002 | Bartolutti et al. |
| 6,359,270 | B1 | | 3/2002 | Bridson |
| 6,428,334 | B1 | | 8/2002 | Skarie et al. |
| 6,534,951 | B2 | | 3/2003 | Kawashima |
| 6,559,882 | B1 | | 5/2003 | Kerchner |
| 6,685,491 | B2 | | 2/2004 | Gergek |
| 6,969,928 | B2 | | 11/2005 | Hanson |
| 6,981,695 | B1 | | 1/2006 | Hedlund et al. |
| 7,024,717 | B2 | | 4/2006 | Hilscher et al. |
| 7,207,080 | B2 | | 4/2007 | Hilscher et al. |
| 7,209,038 | B1 | | 4/2007 | Deconinck et al. |

(Continued)

FOREIGN PATENT DOCUMENTS

EP 0868077 A2 9/1998

(Continued)

*Primary Examiner* — John K Fristoe, Jr.
*Assistant Examiner* — David Colon Morales
(74) *Attorney, Agent, or Firm* — Clifton G. Green; McGarry Bair PC

(57) ABSTRACT

A substance communicating device for use in conjunction with an appliance or a system including an appliance and a consumable holder. The appliance has a first substance service connector component and a first service switch component. The substance communicating device has a second substance service connector component operably engageable with the first substance connector component to permit the communication of a substance between the first and second substance service connector components. The substance communicating device further has a second service switch component operably associated with the second substance service connector component, the second service switch component being configured to engage the first service switch component when the first and second substance service connector components are engaged to selectively permit the communication of the substance between the substance communicating device and the appliance.

39 Claims, 5 Drawing Sheets

U.S. PATENT DOCUMENTS

| | | | | |
|---|---|---|---|---|
| 7,264,026 | B2 * | 9/2007 | Gruber et al. | 141/113 |
| 7,291,032 | B1 | 11/2007 | Carver et al. | |
| 7,354,292 | B1 | 4/2008 | Lloyd et al. | |
| 7,404,298 | B2 | 7/2008 | Kim et al. | |
| 7,493,926 | B2 * | 2/2009 | Weglin | 141/351 |
| 7,584,030 | B1 | 9/2009 | Graham | |
| 7,618,295 | B2 | 11/2009 | McCoy | |
| 7,625,246 | B2 | 12/2009 | McCoy et al. | |
| 7,639,485 | B2 | 12/2009 | McCoy | |
| 7,651,368 | B2 | 1/2010 | Kendall et al. | |
| 7,686,127 | B2 | 3/2010 | LeClear et al. | |
| 7,713,090 | B2 | 5/2010 | Kendall et al. | |
| 7,740,505 | B2 | 6/2010 | McCoy | |
| 7,740,506 | B2 | 6/2010 | McCoy | |
| 7,748,494 | B2 | 7/2010 | LeClear et al. | |
| 7,751,184 | B2 | 7/2010 | McCoy | |
| 7,765,332 | B2 | 7/2010 | McCoy et al. | |
| 7,798,865 | B2 | 9/2010 | McCoy et al. | |
| 7,810,343 | B2 | 10/2010 | McCoy et al. | |
| 7,826,203 | B2 | 11/2010 | McCoy | |
| 7,841,907 | B2 | 11/2010 | McCoy | |
| 7,843,697 | B2 | 11/2010 | McCoy et al. | |
| 7,852,619 | B2 | 12/2010 | McCoy | |
| 7,865,639 | B2 | 1/2011 | McCoy et al. | |
| 7,869,201 | B2 | 1/2011 | McCoy et al. | |
| 7,870,753 | B2 | 1/2011 | Marcy et al. | |
| 7,871,300 | B2 | 1/2011 | McCoy et al. | |
| 7,898,812 | B2 | 3/2011 | McCoy et al. | |
| 7,903,397 | B2 | 3/2011 | McCoy | |
| 7,916,336 | B2 | 3/2011 | Silverbrook et al. | |
| 7,931,114 | B2 | 4/2011 | LeClear et al. | |
| 7,934,958 | B2 | 5/2011 | Kendall et al. | |
| 7,980,088 | B2 | 7/2011 | LeClear et al. | |
| 8,035,958 | B2 | 10/2011 | Kendall et al. | |
| 8,040,666 | B2 | 10/2011 | McCoy et al. | |
| 8,151,016 | B2 | 4/2012 | McCoy | |
| 2003/0037447 | A1 | 2/2003 | Gruber et al. | |
| 2003/0154338 | A1 | 8/2003 | Boz et al. | |
| 2004/0036273 | A1 | 2/2004 | McClary | |
| 2004/0154318 | A1 | 8/2004 | Roh et al. | |
| 2005/0011205 | A1 | 1/2005 | Holmes et al. | |
| 2006/0053655 | A1 | 3/2006 | Weglin | |
| 2006/0118694 | A1 | 6/2006 | Lee et al. | |
| 2006/0125360 | A1 | 6/2006 | Kim et al. | |
| 2006/0168236 | A1 | 7/2006 | Higuma et al. | |
| 2007/0086151 | A1 | 4/2007 | Oh et al. | |
| 2008/0065289 | A1 | 3/2008 | Bertosa et al. | |
| 2008/0164224 | A1 | 7/2008 | McCoy et al. | |
| 2008/0164225 | A1 | 7/2008 | McCoy | |
| 2008/0164226 | A1 | 7/2008 | McCoy et al. | |
| 2008/0164227 | A1 | 7/2008 | LeClear et al. | |
| 2008/0164796 | A1 | 7/2008 | McCoy et al. | |
| 2008/0165282 | A1 | 7/2008 | Marcy et al. | |
| 2008/0165474 | A1 | 7/2008 | McCoy et al. | |
| 2008/0165475 | A1 | 7/2008 | McCoy et al. | |
| 2008/0165476 | A1 | 7/2008 | McCoy et al. | |
| 2008/0165478 | A1 | 7/2008 | McCoy | |
| 2008/0165505 | A1 | 7/2008 | McCoy et al. | |
| 2008/0165509 | A1 | 7/2008 | Kendall et al. | |
| 2008/0165998 | A1 | 7/2008 | LeClear et al. | |
| 2008/0166895 | A1 | 7/2008 | McCoy et al. | |
| 2008/0166915 | A1 | 7/2008 | Kendall et al. | |
| 2008/0168205 | A1 | 7/2008 | McCoy et al. | |
| 2008/0192411 | A1 | 8/2008 | McCoy | |
| 2008/0201032 | A1 | 8/2008 | Fayyad et al. | |
| 2008/0222327 | A1 | 9/2008 | McCoy et al. | |
| 2008/0231464 | A1 | 9/2008 | Lewis et al. | |
| 2008/0231764 | A1 | 9/2008 | Kendall et al. | |
| 2008/0232053 | A1 | 9/2008 | Kendall et al. | |
| 2008/0247141 | A1 | 10/2008 | Kendall et al. | |
| 2008/0287009 | A1 | 11/2008 | McCoy | |
| 2009/0009316 | A1 | 1/2009 | Kendall et al. | |
| 2009/0047824 | A1 | 2/2009 | Seibert et al. | |
| 2009/0054804 | A1 | 2/2009 | Gharib et al. | |
| 2010/0120284 | A1 | 5/2010 | Oka et al. | |
| 2010/0182753 | A1 | 7/2010 | Kendall et al. | |
| 2010/0248546 | A1 | 9/2010 | McCoy | |
| 2011/0049308 | A1 | 3/2011 | Beaman et al. | |
| 2011/0146328 | A1 | 6/2011 | Hendrickson et al. | |
| 2011/0146329 | A1 | 6/2011 | Kuehl et al. | |
| 2011/0146330 | A1 | 6/2011 | Kuehl et al. | |
| 2011/0146819 | A1 | 6/2011 | Hendrickson et al. | |
| 2011/0147159 | A1 | 6/2011 | Kuehl et al. | |
| 2011/0147160 | A1 | 6/2011 | Kuehl et al. | |
| 2011/0147161 | A1 | 6/2011 | Kuehl et al. | |
| 2011/0147417 | A1 | 6/2011 | Kuehl | |
| 2011/0148216 | A1 | 6/2011 | McCoy | |
| 2011/0148223 | A1 | 6/2011 | McCoy | |
| 2011/0148649 | A1 | 6/2011 | de Cavalcanti et al. | |
| 2011/0148650 | A1 | 6/2011 | Jenkins et al. | |
| 2011/0148651 | A1 | 6/2011 | Hendrickson et al. | |
| 2011/0149485 | A1 | 6/2011 | Kuehl et al. | |
| 2011/0152024 | A1 | 6/2011 | Kuehl | |
| 2011/0153739 | A1 | 6/2011 | McCoy | |
| 2011/0153821 | A1 | 6/2011 | McCoy | |
| 2011/0153871 | A1 | 6/2011 | Ferragut, II et al. | |
| 2011/0153880 | A1 | 6/2011 | McCoy | |

FOREIGN PATENT DOCUMENTS

| | | | |
|---|---|---|---|
| JP | 60033716 | A | 2/1985 |
| JP | 06310202 | A | 11/1994 |
| JP | 06310204 | A | 11/1994 |
| JP | 06333633 | A | 12/1994 |
| JP | 2007080584 | A | 3/2007 |
| WO | 2007/015274 | A1 | 2/2007 |

* cited by examiner

SUBSTANCE COMMUNICATING DEVICE WITH MECHANICALLY ENERGIZED CONNECTOR

BACKGROUND

Appliances and other useful household equipment are increasingly designed to interact with one another, as well as with a variety of consumer accessory devices. A consumer accessory device may be used, for example, in conjunction with an appliance to enhance or supplement the functionality of the appliance.

BRIEF SUMMARY

The invention relates to substance communicating devices for use in conjunction with an appliance and couplings system for substance communicating devices.

According to one aspect of the invention, a substance communicating device is used in conjunction with an appliance having a first substance service connector component and a first contact proximity coupling component. The substance communicating device comprises a main body, a substance consumer associated with the main body, a substance line having a first end coupled with the substance consumer and a second end remote from the first end, a second substance service connector component coupled with the second end of the substance line, the second substance service connector component being operably engageable with the first substance service connector component to permit the communication of a substance between the first and second substance service connector components, and a second contact proximity coupling component being configured to engage the first contact proximity coupling component when the first and second substance service connector components are engaged to selectively permit the communication of the substance between the substance communicating device and the appliance.

According to another aspect of the invention, a system comprises an appliance having a first substance service connector component, a substance communicating device having a second substance service connector component operably engageable with the first substance service connector component, a contact proximity coupling system comprising a service switch operably associated with one of the first and second substance service connector components, the service switch being configured to selectively permit the communication of a substance between the substance communicating device and the appliance, and a contact proximity target associated with the other of the first and second substance service connector components, the contact proximity target being configured to selectively communicate with the service switch when the first and second substance service connectors are engaged to permit the communication of the substance between the substance communicating device and the appliance.

According to yet another aspect of the invention, an accessory is used in conjunction with an appliance having a first substance communicating device, a first substance service connector component coupled for communicating substance with the first substance communicating device, and a first contact proximity coupling device. The accessory comprises a main body having a second substance communicating device, a second substance service connector component coupled for communication of substance with the first substance communicating device, the second substance service connector component being operably engageable with the first substance service connector component to permit the communication of a substance between the first and second substance service connector components, and a second contact proximity coupling device being configured to engage the first contact proximity coupling device when the first and second substance service connector components are engaged to selectively permit the communication of the substance between the accessory and the appliance.

DETAILED DESCRIPTION

Figure 1:
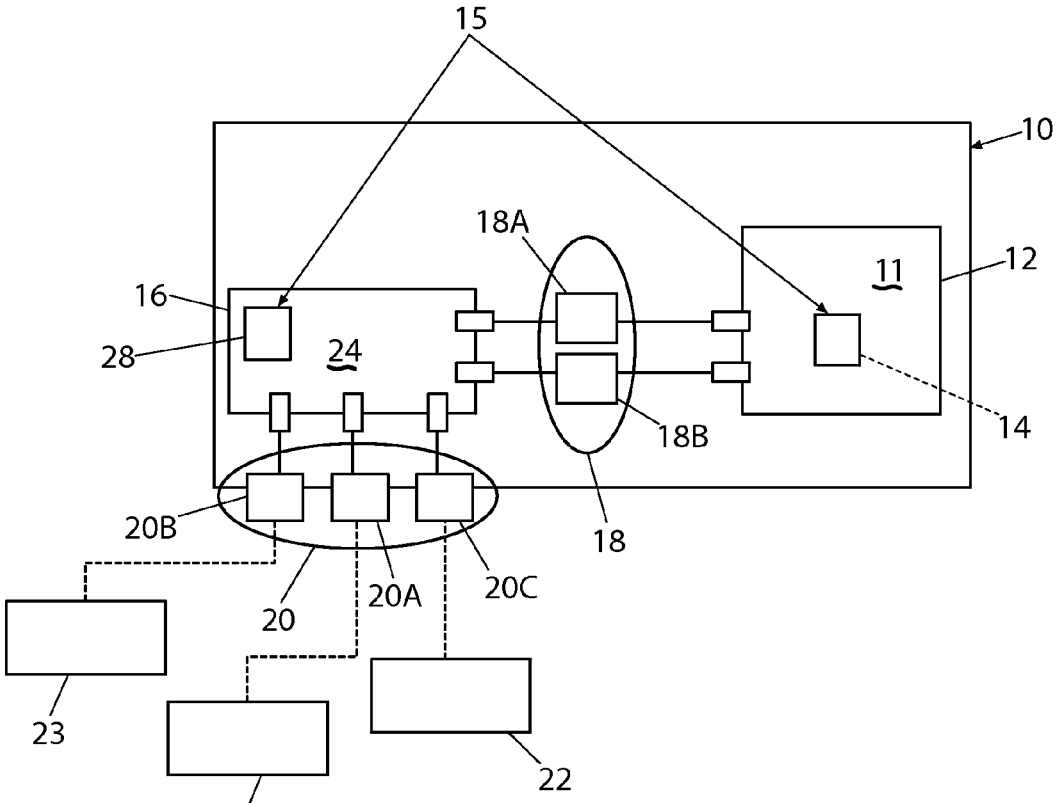
FIG. 1 is a schematic view of an appliance coupled to, and comprising, a consumable holder.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or to otherwise limit or restrict the claims to the precise forms and configurations shown in the drawings and disclosed in the following detailed description.

The drawings and the following detailed description relate generally to substance communicating devices and coupling systems for connecting substance communicating devices. The following definitions apply to terms that may be used in the specification and the claims, unless otherwise noted.

As used herein, a "substance" is a material that may be communicated from one device to another. A substance may include a gas, a liquid, or a solid, or any combination thereof. Examples of substances include, but are not limited to, liquid soap, powdered soap, compressed air, tablets, caplets, water, ice cubes, and a beverage.

As used herein, "substance communication" or a "substance communication service" is a useful provision of a substance from one device to another device. Communicating a substance includes supplying or receiving a substance. As used herein, communication of substance includes both unidirectional and multi-directional communication between any two devices, either directly or through an adapter, as defined herein. Substance communication may be provided in quanta, such as capsules or other doses of substances, batches of discrete items, such as tablets, or consumable components.

The term "consumable" and any variation thereof, as used herein, includes any substance that may be consumed by a host, an accessory device, or a user person, such as food, cosmetics, or medicine. The consumable may, for example, be a substance that is used up and must be replenished for subsequent cycles of operation. For a clothes washer, a consumable might be a detergent and/or a softener. For a clothes dryer, a consumable might be an anti-static cloth. For a cooking or refrigeration appliance, the consumable may actually be the article on which the appliance performs its cycle of operation, as in the case of food, later to be consumed by a person. More specific examples of the use of a consumable in appliances include dispensing additives for clothes washers, clothes dryers, or combination washer/dryer appliances. The additives may include, but are not limited to, normal detergents, gentle detergents, dark clothing detergents, cold water detergents, fabric softeners, chlorine bleaches, color-safe bleaches, and fabric enhancement chemistry. Non-limiting examples of fabric enhancers are additives to provide stain resistance, wrinkle resistance, water repellency, insect repellency, color fastness, fragrances, and anti-microbials. Another example of a consumable is the filters used by an appliance. Refrigerators, dryers, washers, and dishwashers are all known to use filters that are consumed in the sense that they wear out and must be replaced.

The term "substance consumer" and any variation thereof, as used herein, is any useful device that employs, uses, stores, or dispenses a substance in connection with performing a physical or virtual function. A substance consumer may be, for example, a smart utensil, an appliance, a resource controller, such as a water controller, a dispenser, a filter, a water filter, an air filter, a detergent dispenser, a drink dispenser, a detergent cartridge, a substance holder, such as a cycle accessory.

The term "substance provider" and any variation thereof, as used herein, is any device that is capable of providing or supplying a substance to another device.

As used herein, the term "substance holder" is anything that holds or contains a substance, which may include, but is not limited to, a container, a dispenser, a cartridge, a dish, a bag, or a carton.

As used herein, the term "consumable holder" is any substance holder that holds or contains a consumable.

As used herein, the terms "substance communication coupling system" or "substance service connector system" refer to any connector system having at least two separate substance communication coupling system components, each of which is associated with a useful device. The substance communication coupling system components cooperate with one another to couple the useful devices to facilitate communication of a substance between the useful devices.

As used herein, the term "substance switch" is any component used to selectively facilitate the communication of a substance between components of a substance coupling system, such as by drawing the components into engagement or by permitting the flow of a substance from one of the components for transfer to the other of the components.

As used herein, the term "switching valve" is any valve used to selectively facilitate the communication of a substance between components of a substance communication coupling system.

As used herein, the terms "substance line" or "substance pathway" refer to a pathway for transferring a substance from one location to another. The substance line may have any of a variety of configurations depending on the type of substance being transferred, including, but not limited to, a pipe, a conduit, a tube, a channel, or fluidically-aligned supply and receiver ports with a gap therebetween.

As used herein, an "electromagnetic service" is electrical power or data. An electromagnetic service may comprise multiple categories of electromagnetic service, such as electrical power and data in a single signal. An electromagnetic service may be provided continuously, for specified times, for specified amounts, or for the duration of certain events, such as the duration of coupling to provide timed dispensing. Alternatively, an electromagnetic service may be provided in quanta, such, as packets of data. Also alternatively, an electromagnetic service may include data encoded into in waves such as light, radio, and sound.

"Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

"Electrical power communication" is the coupling of at least two devices to supply electrical power from at least one of the devices to the other of the devices, such as through directly connected electronic lines or through wireless power communication (also referred to as wireless power transmission). Wireless power communication may include any type of wireless power communication, including, without limitation for illustration purposes, microwave transmission, laser transmission, and magnetic fields. Exemplary categories of power communication include the type of power, e.g. alternating current (also known as AC) or direct current (also known as DC), supplied to the functional device and variations in the characteristics of the power, such as the voltage or current.

"Data communication" is the coupling of at least two devices to transmit data from at least one of the devices to the other of the devices, such as through directly connected electronic lines or through wireless data communication (also referred to as wireless data transmission). The data may be transmitted as a separate signal or embedded in electrical power communication. Wireless data communication may include any type of wireless data communication, including, without limitation for illustration purposes, wireless network technology (a/k/a Wi-Fi), radio transmission, light transmission, and acoustical transmission. Exemplary categories of data communication include encrypted and unencrypted data. Data communication also includes communication for different protocols, including physical layer protocols and software layer protocols. Examples of physical layer protocols are a wired Ethernet and a wireless (using Wi-Fi) network, both of which may support the same data packet structure. Examples of software layer protocol are Zigbee® and Bluetooth®. Data communication may also be completed by way of an analog mechanical transmission means such as by means of fluidic pulses created by positive pressure systems or vacuum systems or by a mechanical logic transfer means, such as the throwing of switches or levers to actuate or transmit information about a control state.

"Communicating" as used herein with respect to an electromagnetic service means supplying or receiving an electromagnetic service. As used herein, communication of electromagnetic service includes both uni-directional and multi-directional communication between any two devices, either directly or through an adapter, as defined herein.

A "substance communicating device" is any substance holder, substance provider or substance consumer that is capable of communicating substance with another device. Examples of a substance communicating device include a dispenser, a filter, a water filter, an air filter, a detergent dispenser, a drink dispenser, a detergent cartridge, a bottle, a jug, a flavoring dispenser, a steam dispenser, a fragrance dispenser, an food ingredient dispenser, a cycle accessory, and a chemistry dispenser.

A "substance communicating system" is any combination of substance communicating devices capable of communicating a substance therebetween.

A "service connector system" is a connector system having at least two separate service connector components, also referred to as service couplers, each associated with a useful device. The service connector components cooperate with one another to couple the useful devices to facilitate communication of a service between the useful devices. A service connector system may carry multiple services. An electromagnetic service connector system, for example, may be associated with or incorporated into a substance connector or may be independent of a substance connector but be associated with the same substance holder, substance provider or substance consumer.

A "switched service connector system" is a service connector system having a switching capability in at least one of the service connector components operable to selectively permit the communication of a service between the components of the service connector system.

A "service switch" is any component used to selectively permit the communication of a service between components of a service connector system. A service switch which selectively permits the communication of a substance may be referred to as a "substance switch". A service switch may be associated with more than one type of service. For example, an electromagnetic service switch may be associated with, integrated with, or comprise a substance switch or may be independent of a substance switch.

A "service line" is a pathway for transferring a service from one location to another. The service line may have any of a variety of configurations, including, but not limited to, a pipe, a conduit, a wire, a tube, a channel, and a fiber optic cable. More particularly, to transfer electrical power or data service communication, an electromagnetic service line may include an electrically conductive wire, an optical data cable, or a wireless transmission system.

The terms "provide" and "supply" and any variation thereof, are used herein to denote a source of the substance or an electromagnetic service relative to a device receiving the substance or electromagnetic service. Neither term is limited to the original source of the substance or electromagnetic service. A device that provides or supplies the substance or electromagnetic service may simply be passing on the substance or electromagnetic service from the original source. For example, a device that provides water may pass on water it receives from a residential water supply. However, the device may alternatively or additionally provide another substance that originates with the device, such as an additive stored in a reservoir.

The term "receive" and any variation thereof is used herein to denote receipt of the substance or an electromagnetic service relative to the device providing the substance or electromagnetic service. The term not limited to the ultimate consumer of the substance or electromagnetic service. The term "receive" is applicable as well to a device that may simply be passing on the substance or electromagnetic service from the source, such as an appliance, to a device that will consume, as hereinafter defined, the substance or electromagnetic service. The device which receives a substance is not necessarily the end consumer of the substance or electromagnetic service.

The term "consume" and any variation thereof, as used herein, denotes the act of employing or dispensing at least a portion of the substance or electromagnetic service received in connection with performing a function.

The term "coupled" and any variation thereof, as used herein, includes any type of connection that permits transfer of a substance or an electromagnetic service between two devices. The term "coupled" does not require a physical connection between the two devices, so long as the coupling permits transfer of a substance or an electromagnetic service. The term "coupled" includes both fixed and removable coupling, as well as both continuous and intermittent coupling.

The term "useful device" and any variation thereof, as used herein, is a device that is capable of performing a useful physical or virtual function either alone or in combination with another device.

As used herein, the term "host" is an apparatus that has a primary function independent of providing or receiving a substance. A host may be a substance provider, a substance consumer, or both. For example, the host may be an appliance and the primary function may be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host may alternatively comprise a structural feature of a building, such as a wall, a cabinet, or a door. The host may also provide other services, such as electrical power, electronic data, mechanical power, illumination, heat, or sound.

As used herein, the terms "accessory" or an "accessory device" refer to any useful device which may be coupled to a host and communicate a substance to or from the host. An accessory device may be used primarily in conjunction with a host to enhance, supplement, regulate, or monitor the functionality of the host or may have independent functionality and utility. An accessory device may be a substance provider, a substance consumer, or both. An accessory device may be a substance holder or a consumable holder. Examples of an accessory device include, but are not limited to, a paper product dispenser, a dry goods dispenser, a bottle opener, a liquid dispenser, a pill dispenser, a water dispenser, a fan, a motor, a tissue dispenser, a can opener, a mixer, a blender, an ice dispenser, an ice maker, an ice cream maker, a coffee maker, a soap dispenser, and a softener dispenser. An accessory or accessory device may also communicate electromagnetic service with the host.

A "proximity target" as used herein is any component or device that may be detected when positioned within a predetermined distance of an associated proximity sensor, defined below. A proximity target may be passive, such as a visual target or a magnetic target formed of magnetic or magnetic responsive material. Other examples of passive proximity targets may include a conductive component or surface capable of cooperating with a magnetic field, a current, or a voltage provided by a proximity sensor. A proximity target may alternatively be active or powered such as an electromagnet, a generator of a magnetic field, a current, a voltage or an acoustic wave. An active proximity target may alternatively provide a powered readable display or dispense a detectable chemical.

A "proximity sensor" as used herein is any component or device that may detect an associated proximity target when the proximity target is within a predetermined distance of the proximity sensor. A proximity sensor may detect, for example, a change in an electromagnetic field, an electromagnetic wave, an acoustic wave, a visual target, a chemical component, an electrical signal, a change in voltage, a change in current, a change in frequency, a change in resistance, a change in inductance, a change in capacitance, a mechanical signal, a change in pressure, a displacement, a vibration, and the presence of a chemical, A proximity sensor may be active or passive, such as a magnetic sensor of magnetic or magnet responsive material, or may alternatively be active. Examples of active sensors include active magnetic sensors, light sensors, optical sensors, acoustic sensors, electromagnetic sensors, chemical sensors and thermal sensors. Examples of magnetic sensors include magnets and magnetic responsive components. Examples of optical sensors include infrared sensors, photoelectric sensors, fiber optic sensors, photo resistors, photovoltaic sensors, photo diodes and cameras. Examples of electromagnetic sensors include radio receivers, radar sensors, Hall Effect sensors, inductive sensors, capacitive sensors, variable reluctance sensors and eddy current sensors. Examples of acoustic sensors include ultrasonic sensors and microphones. A contact proximity sensor detects a proximity target by touching the proximity target. A contactless proximity sensor detects the proximity target through a wireless or contactless means. For example, magnetic flux can be used as the signaling mechanism between a contactless proximity sensor and a contactless proximity target.

As used herein, the term "proximity system" is a system that uses a "proximity switch" operated by a plurality of "proximity coupling components," each associated with a different parent device, for determining that the parent devices are in proximity with each other. Parent devices are usually paired, examples of which include a service provide and a service consumer, a host and an accessory, and a host and an adapter. Proximity coupling components may include a proximity target associated with one parent device to actively or passively provide an indication of the presence of the one parent device and a proximity sensor associated with the other parent device that is responsive to the presence of the proximity target to activate the proximity switch. The proximity switch may be used to provide a signal or message indicative of the proximity of the parent devices or may directly or indirectly regulate the flow of a service along a service line. The proximity systems disclosed in herein employ contact proximity systems, wherein the proximity target and proximity switch use physical contact to detect the proximity of the two parent devices.

A "plug" as used herein is a generally male electromagnetic service connection component.

A "receptacle" as used herein is a generally female electromagnetic service connection component.

As used herein, the term "adapter" is an intermediate device that may be provided between a first and second useful device, such as between a host and an accessory, to facilitate the communication of substances between the first and second useful devices. An adapter may receive a substance from the first useful device and provide the substance or a modified version of the substance to the second useful device, for example, by providing a substance or by dispensing substance through a metering process, by processing the substance, or by combining the substance with an additive, for example. In some applications, multiple adapters may be interposed between two useful devices. In other applications, three or more useful devices may be coupled to a single adapter, such as multiple accessories for a host. In some applications, the adapter may itself be a useful device providing a useful function not provided by the other useful device or devices coupled to it. An adapter may also facilitate the communication of an electromagnetic service between the first and second useful devices. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

Figure 2:
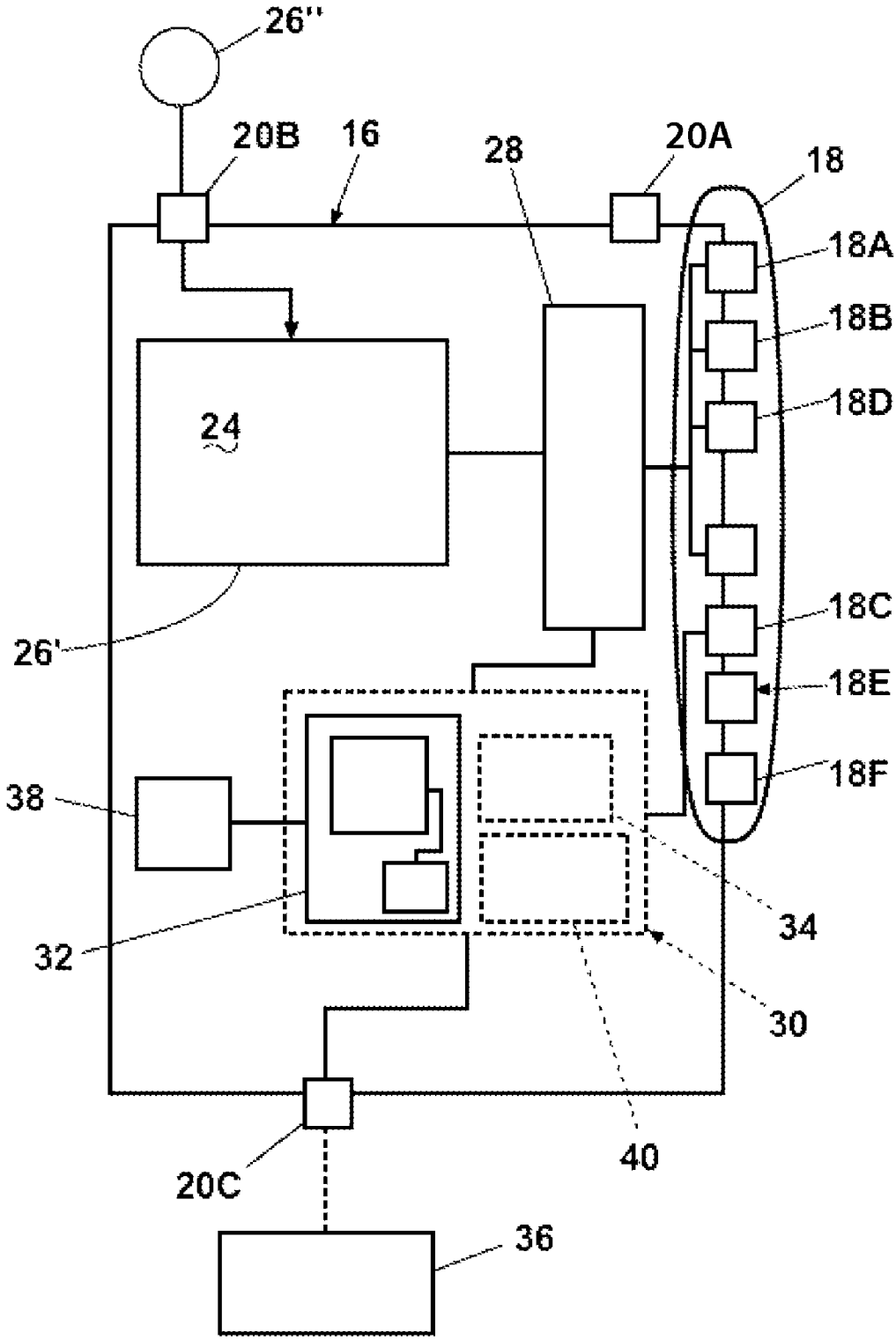
FIG. 2 is a schematic view of the consumable holder of FIG. 1.

Referring to FIG. 1, a substance handling system 10 is illustrated in schematic form and has a first substance communicating device 12, such as an appliance, with a smart process control apparatus 14, and a second substance communicating device 16, such as a consumable holder. Second substance communicating device 16 may be disposed inside or outside or on the first substance communicating device 12. It may be installed during manufacture and sold with first substance communicating device 12, or it may be made and sold separately as an upgrade or addition. Second substance communicating device 16 may optionally have its own process control apparatus 28, which may be in communication with smart process control apparatus 14 of first substance communicating device 12 or may operate independently. Process control apparatus 14 and 28 may provide at least a portion of the system software architecture and electronics 15 for substance handling system 10. Process control apparatus 14 and 28 may include sensors, actuators, wiring, and other components normally found in an electro-mechanical or mechanical control system. Either process control apparatus 14 or 28 may be able to control itself in limited ways through mechanical techniques. More typically and as illustrated herein, electronics 30, shown in FIG. 2, are connected to the process control apparatus 28 providing additional functionality. Process control apparatus 28 and electronics 30 may be considered in combination as a process control apparatus. Smart process control apparatus 14 may also include electronics which interact with the process control apparatus 14 in order to make control decisions based on inputs from sensors or networks and execute those decisions either by network message or the control of actuators within the process control apparatus, but the electronics are not illustrated herein.

First substance communicating device 12 may communicate, through one or more interface or service connector system 18, a substance with second substance communicating device 16, and may as well communicate one or more additional services, such as a data service or a power service. Service connector system 18 may include one or more service couplers or connector components, such as 18A and 18B for enabling the communication of one or more services, such as, for example, multiple substance services or a substance service and an electromagnetic service. For example, first substance communicating device 12 may be an automatic clothes washer acting as a host for the second substance communicating device 16, and second substance communicating device 16 may be an additive dispensing accessory capable of dispensing one or more fabric treatment chemicals, such as detergent, bleach or softener, for use by the automatic clothes washer in the processing of a fabric load. As another example, first substance communicating device 12 may be a refrigeration appliance having a water supply and acting as a host for the second substance communicating device 16, and second substance communicating device 16 may be a flavoring dispensing accessory capable of dispensing one or more food flavoring chemicals, such as fruit flavored drink powder, for use by the refrigeration in providing consumers with a flavored drink. As still another example, first substance communicating device 12 may be a refrigeration appliance having a water supply and acting as a host for the second substance communicating device 16, and second substance communicating device 16 may be a drink dispensing accessory holding one or more food flavoring chemicals, such as fruit flavored drink powder, and capable of receiving cooled water from the refrigeration appliance, mixing it with a food flavoring chemical, and dispensing a drink to a consumer. These and other examples are discussed below in more detail.

In general, first substance communicating device 12 may be configured to perform an operation on a physical article 11, such as clothing or food, using a resource, such as water, temperature-controlled air (hot or cold), steam, gas, or electricity, provided to first substance communicating device 12 by interfaces, not shown, with a utility, not shown, supplying the resource. Examples of appliances that perform an operation on physical article include a wide range of device types, including but not limited to, washers, dryers, ovens, ranges, steam cookers, ice makers, refrigerators, drink makers and the like. Articles 11 are the objects upon which a user intends the appliance to perform its cycle of operation. Typical examples as mentioned above would include food and clothing.

Smart process control apparatus 14 is configured to implement and control a cycle comprising at least one operation. Smart process control apparatus 14 may comprise one or more components, not shown, such as electronic control boards, wiring and wiring harnesses, power-supplies, sensors integrated with the electronics as digital or analog inputs, and actuators like valves, relays, heaters, and the like, any or all of which may integrate with the electronics as digital or analog outputs.

Exemplary second substance communicating device 16 is configured to hold, carry, supply, communicate with, or otherwise interact directly with a consulable 24. When performing a cycle of operation on an article 11, first substance communicating device 12 will often use at least one consulable 24. A consulable 24 in one sense comprises a substance, device, or other product that would be at least partially consumed or transformed by first substance communicating device 12 during a cycle of operation on an article 11, such that consulable 24 may be periodically replaced or replenished. The period after which consumable 24 may be replaced or replenished may be, but is not limited to, a single cycle of operation, multiple cycles of operation, an amount of time, or a number of uses. For example, many common washing machines require that a user place a single dose of detergent in a dispenser prior to initiating a cycle of operation. For each subsequent cycle of operation, the user must again place a single dose in the dispenser, as a single dose of detergent is consumed by the washing machine during each cycle of operation.

In some cases, the consulable 24 may be the article 11, on which the first substance communicating device 12 performs the cycle of operation, and the consumable may be subsequently consumed by a user. A consulable 24 may, for example, be anything that would be consumed or otherwise used by a person, such as food, beverages, cosmetics, or medicine. For example, in a cooking or refrigeration appliance, the consumable may be a food item communicated from a dispenser to an appliance, and the cycle of operation performed by the appliance may be heating or cooling the food.

Consumables are to be distinguished from resources, although resources may in some circumstances be "consumed" during a cycle of operation. Resources are commodities that are continuously available to an appliance, and used by the appliance in its cycles of operation on articles 11 that are supplied by external utilities, such as a residential water, power, data or natural gas distribution system, or are available from the ambient environment, such as air. In some cases, a material resource, such as air and water, may also be considered an article 11 as in a refrigerator that chills and dispenses water. That is, water in that instance is a resource (continuously available to the refrigerator from a residential utility), but also an article 11 (intended by the user for the refrigerator to act upon). The cycles of operation performed by the refrigerator would include the chilling and dispensing. Things that hold or supply resources, such as water supply lines or air conduits are not considered consumable holders. They would be "resource holders", which may be supplied by resource providers. In a refrigerator, for example, water supplied to the first substance communicating device 12 would be considered a resource and/or an article 11. If flavoring is mixed with the water supplied to first substance communicating device 12, the flavoring may be considered a consulable 24, and whatever holds/supplies the flavoring is then considered to be second substance communicating device 16.

Consumables are also to be distinguished from parts in an appliance, although parts wear out and need to be replaced or replenished as do consumables. Parts are devices, without which a cycle of operation by the appliance or a principal function of the appliance would be hampered. Examples include valves, actuators, switches, tubes, lamps, wiring, motors, pumps, seals, gears and the like. Consumables, on the other hand, are typically not critical to the operation of the appliance, although they provide a benefit to a user of the appliance. An appliance may typically still operate on an article 11 in some fashion without a consumable, though not necessarily as effectively or efficiently.

Second substance communicating device 16 comprises a device that holds or contains consulable 24. Typically, consulable 24 is contained by a consumable holder. In some cases, second substance communicating device 16 may be nested within one or more other consumable holders. For example, a cartridge holding a consumable may be disposed in a dispenser.

In some cases articles 11 on which the appliance operates may not be contained by a consumable holder, and may not be consumables in the sense herein defined. Rather, the articles 11 may be enabled to perform at least some of the functionalities of a consumable and/or a substance communicating device. An example of an article 11 with substance communicating device capabilities is a shirt having a bar code thereon containing information that is directly readable by first substance communicating device 12. The bar code may be, for example, on a performance tag. First substance communicating device 12 may use data and/or information represented by the bar code for use in configuring and selecting the cycle of operation of the appliance. The bar code may be read by first substance communicating device 12 while the shirt is being operated contemporaneously with the cycle of operation.

A performance tag is an information holder either integrally formed or selectively attached to an article 11 and adapted to maintain its integrity over the life of the article 11.

For example, a performance tag for clothing would be adapted to maintain its integrity throughout the repeated processes of washing in a washing machine appliance, drying in a dryer, being cleaned at a dry cleaners, being ironed, being left in the sun, and being subjected to the impacts sustained during usage. Examples of impacts sustained during usage for a shirt are those that might occur during a soccer match where the shirt impacts the earth and other players at considerable speeds and forces repeatedly. Likewise, performance tags for dishes would be subjected to similar impacts, and similar wash and dry cycles from a dishwasher. Performance tags integrally formed with fabric items might be sewn in, glued in, woven in, stamped on, or printed on during the manufacturing of the article 11 or by a home machine adapted to integrate the article 11 and the tag. Performance tags integrally formed with dishware might be glued, stamped, printed, embossed, cast, molded, or otherwise formed during the manufacturing of the article 11 or by a home machine adapted to integrate the article 11 and the tag. Performance tags that are selectively attached to an article 11 could be attached by sewing, gluing, pining, sticking, printing, embossing, or other like methods in the home environment for articles 11 not specifically adapted for receiving a performance tag. Performance tags are constructed of any suitable material that may be used to hold encoded information about a cycle structure, or information about a consumable, the description of which is contained herein. Examples of materials for holding the information include magnetic strips, bar codes, and images of encoded data including color patterns, shape patterns, plain texts, numeric identifiers, and the like. An appliance having a cycle architecture and being in communication with a performance tag (as for example by using a consumable reader) may optimize the cycle of operation in the appliance for the article 11 in response to the cycle structure, data about a cycle structure, and/or data about a consumable held by the performance tag. Performance tags may either hold information or hold other information about how to find the information. An example of a performance tag that holds other information is a performance tag holding a URL wherein the data returned when invoking the URL is the information. Further, the appliance may alter or optimize the user experience further by providing information on a user interface in response to the cycle structure, data about a cycle structure, and/or data about a consumable.

Other examples further illustrate the foregoing distinctions. Consider using an oven to cook a turkey in a roasting pan where there is a steam dispenser with a basting cartridge for automatic basting. The turkey is the article 11 upon which the appliance (the oven) performs its cycle of operation (cooking) However, the turkey is also a consumable in the sense that it is a food item to be consumed by the user. The basting cartridge would be a consumable holder and its contents a consumable. The water used to generate the steam is a resource, making the steam a changed resource. The roasting pan would be a second consumable holder, holding the turkey. The appliance or the roasting pan or some other device (such as a performance tag described below) may also hold information about the turkey or how to cook a turkey or how to cook a turkey in different kinds of ovens. Such information would be considered information about a consumable and information about a cycle structure.

Consider also a powdered detergent box with a performance tag configured to communicate with an appliance contemporaneously with the dispensing of the detergent to a washer. The washer is the appliance, the detergent is a consumable, and the box is a consumable holder. The performance tag may hold information about the chemistry of the powder, information about cycle structures, and data about cycle structures wherein the information and data are associated with other information comprising appliance types, fabric types, stain types, and the like so that the data and information may be used alone or combined with the other information to create a cycle of operation in response to the data and the information and in response to the user and the user preferences about the cycle of operation, the data, the information, and the other information.

Consider also a detergent pellet with an etched or embossed or imprinted cycle structure enabled to communicate with an appliance contemporaneously with being introduced into a washing machine before or during a wash cycle. Here, the washing machine is an appliance and the detergent pellet is a consumable. There is no separate consumable holder. The cycle structure is intended to effect the cycle of operation (washing). Consider also a detergent pellet having a data pod. The detergent pellet is a consumable, but the data pod is a form of performance tag that could communicate with an appliance contemporaneously with being introduced into the use environment for the purpose of effecting the cycle of operation.

A consumable or a consumable holder or a performance tag or data pod or anything that may hold and convey information (consumable information holder) might comprise one or more cycle structures. A first cycle structure may be associated with a first appliance or first appliance type and a second cycle structure may be associated with a second appliance or a second appliance type such that the appropriate cycle structures are introduced to the appropriate appliance or appliance type when the consumable or consumable holder is in useful communication with the appliances. For example, a frozen food (a consumable) or a package of frozen food (a consumable holder) might have cycle instructions for freezing, defrosting, or preserving cycles in a refrigerator or freezer appliance, and also might have cycle instructions for defrosting, cooking, or warming cycles for a cooking appliance like an oven or microwave.

A consumable information holder may comprise one or more user interface data sets, with or without cycle structures, which may be communicated to a user interface, such as might be on the appliance. User interface data is considered to include anything that may be rendered to be responsive to a user's senses, such a visual displays, audible sounds, and tactile displays. A first user interface data set may be associated with a first appliance or first appliance type and a second user interface data set may be associated with a second appliance or a second appliance type such that the appropriate user interface data are conveyed to a user interface associated with the appropriate appliance or appliance type when the consumable or consumable holder is in useful communication with the appliances. For example, a frozen food (a consumable) or a package of frozen food (a consumable holder) might convey to a refrigerator an expiration date to be rendered on a user interface on the refrigerator. The frozen food or its package might also convey to an oven serving suggestions to be rendered on a user interface on the oven.

Consumables, consumable holders, performance tags, data pods and the like (consumable information holders) may be enabled not only to provide data, but also may be configured to receive and store information associated with the consumable. Exemplary information includes data about a consumable, a cycle structure, data about a cycle structure, tracking the number of times a shirt or a dish is washed, the number of cycles and the parameters thereof, which have been executed by or in combination with an appliance and consumable holder. It may also include the types of consumables introduced into the use environment, information entered into an appliance user interface including cycle selections, usage patterns, user information, user identification, other data associated with the cycle of operation of an appliance, and any data held by a data source in communication with the holder, tag, or pod which either the data source writes to the holder, tag, or pod, or any data or the holder, tag, and pod reads from the data source. Such information may be sequentially added to a database on the consumable information holder for later retrieval. For example, a shirt with a performance tag may keep data about how many times it has been washed, about different wash cycles it has been through, and the specific machines in which it has been washed.

More specific examples of consumables 24 for use with or by appliances 12 include dispensing additives for laundry washers, dryers, or combination washer/dryer appliances. Other additive examples are provided in the definition of consumables above.

An additive dispenser in this case would be second substance communicating device 16 and may be a single load dispenser that dispenses all of additive contained therein during a single cycle or a bulk dispenser that dispenses only some of the additive contained therein during a single cycle. An appliance comprising a bulk dispenser may meter and dispense the correct amount of additive for each particular load and provide information to the user regarding the remaining amount of additive in the bulk dispenser after dispensing.

Because each additive may have different parameters associated with its use, information about each consumable may be provided with each consulable 24. This information may be provided on the packaging of consulable 24 (i.e. the consumable holder), in consulable 24, or by any other suitable means (performance tag, data pod, user interface, etc.). For example, different additives may have different concentrations, and the amount of a given additive needed for a particular load will vary depending on the concentration of that additive. The amount of a particular additive needed to complete a cycle of operation will also depend on the amount and type of laundry being treated, as well as the condition of the laundry (e.g. soil and stain level). The amount, type, and condition of the laundry may be determined utilizing information supplied by the user, information gathered by sensors associated with the appliance, or information otherwise obtained during the operation of the first substance communicating device 12.

Additional information provided with the consumable may also be used to tailor the cycle of operation to that consulable 24. In a laundry application, the additive will have to be dispensed at the right time during the cycle, such as before, during, or after wash, rinse, spin, or drying. Particular additives may also require that they are dispensed under certain conditions, such as at a given water temperature or air temperature. Additionally, particular additives might require at least one additional step in a cycle for optimal performance. For example, the presence of a particular additive might require that the cycle structure be augmented by inserting an additional ordered collection of steps such as filling at a new temperatures to a new level after spinning, then soaking for an amount of time, then draining, then spinning for a new amount of time at a new spin speed between the original step in the cycle and the last step in the cycle.

The smart process control apparatus 14 or electronics 30 may determine parameters to be used for the cycle of operation or the structure of the appropriate cycle of operation or changes to an existing cycle of operation for different operations based on the information provided with consulable 24, user input, and information obtained by sensors associated with first substance communicating device 12. Exemplary types and sources of information are found in the following table:

| Information provided from the consumable or consumable holder | Information provided by the user | Information provided by appliance sensors |
|---|---|---|
| New order collection of cycle steps, actions for each step, a plurality of transition logic expressions for each step, and the relationships between steps, actions, and logic expressions | Fabric type | Soil level |
| Additive type | Desired cycle | Load weight |
| When in cycle to dispense | Fabric type | Load absorption |
| Any special cycle parameters | Load size | Additive remaining in dispenser |
| Amount to dispense for a standard load | Fabric condition (soil level, stains, etc.) | Soil level |
| Special dispenser maintenance considerations | Dispensing compartment used | None |

Another example of a consumable includes filters used by first substance communicating device 12. Refrigerators, dryers, washers, and dishwashers are all known to use filters that are consumed in the sense that they must be replaced after a certain amount of time or usage due to wear and dirtying of the filter. Filters, in particular, depending on the embodiment may be construed as a consumable, a consumable holder, or both. For example, if there is a filter assembly holding a filtering material, then the filter assembly may be considered a consumable holder and the filtering material may be considered a consumable because it is disposed of after it usability is consumed; its life and the life of the consumable holder are significantly different. On the other hand, the filter assembly and the filter material may be integrally formed and introduced and removed from the use environment as a unit. In this case, the assembly and the filter material would be considered both a consumable holder and consumable because the assembly and the filter material comprise functionality and attributes of both consumable holders and consumables.

Consumables may also include food, as mentioned above, and articles of clothing. Such consumables may or may not be contained by a consumable holder. However, non-contained consumables may still have consumable holder functionality in that they may comprise information about the consumable that is retrievable by the appliance. For example, a food item may carry information about itself that is contained in edible ink printed on the surface of the food item.

Returning to the drawings, service connector system 18 may be an internal or external interface configured to removably couple second substance communicating device 16 and first substance communicating device 12. System 10 may also be provided with an interface 20 for removably connecting one or more additional accessory devices 22, 23 or 25. Interface 20 couples accessory devices 22, 23 or 25 to second substance communicating device 16, but it will be appreciated that such an interface may alternatively or additionally be provided on first substance communicating device 12.

Interface 20 may include one or more connector components, such as 20A, 20B and 20C, for enabling the communication of a one or more services provided by any other source or device, such as accessory devices 22, 23 and 25, that may be advantageously used with the first substance communicating device 12 and/or second substance communicating device 16. One or more of the accessory devices 22, 23 and 25 may have a process control apparatus, not shown, that may interact with or become a part of system architecture and electronics 15 when coupled with substance handling system 10.

Accessory device 22 may, for example, comprise a power source, a consumable source, a consumable dispenser, a consumable reader, a data processor, or a component that may facilitate engagement or interaction with second substance communicating device 16. In another example, second substance communicating device 16 may act as an adapter between first substance communicating device 12 and accessory device 22 for communicating a service therebetween. Accessory device 23 may be a consumable reader, including a bar code or RFID tag reader and a microprocessor. Alternatively, a consumable reader may be incorporated into first substance communicating device 12 or second substance communicating device 16 and accessory device 23 may be a sensor for the consumable reader. Accessory device 25 may be a bulk source of consulable 24, such as a large bottle of detergent, which provides second substance communicating device 16 with a replenished supply of consulable 24 as second substance communicating device 16 dispenses a dose of consulable 24 into first substance communicating device 12.

System architecture and electronics 15 may include software, not shown, enabling at least one of first substance communicating device 12, second substance communicating device 16, or accessory devices 22, 23 or 25 to discover other devices using network messages.

Referring now to FIG. 2, illustrating schematically more details of second substance communicating device 16, service connector system 18 may include a plurality of service connector components 18A-F. Each connector component may communicate one or more service, and may enable one or more function. For example, a connector component 18A may communicate a consulable 24 to second substance communicating device 16, connector component 18B may communicate a non-consumable substance to second substance communicating device 16, connector component 18C may communicate the non-consumable substance back to first substance communicating device 12, connector component 18D may communicate data between first substance communicating device 12 and second substance communicating device 16, connector component 18E may couple two power contacts of second substance communicating device 16 to two power contacts of first substance communicating device 12, and connector component 18F may couple a power take-off associated with first substance communicating device 12 with a mechanical powered device associated with second substance communicating device 16. Any service communicated through connector components 18A-18F may be consumed, returned, stored, or passed on to a third device by the device receiving the service. The service may be used to trigger or enable an event, such as to trigger a dispensing event, modify data, or affect a cycle of operation. For example, a mechanical, electrical or data service from first substance communicating device may trigger an actuator in second substance communicating device 16. A substance communicated across a service connector system may be a consumable, a resource or non-consumable substance. Substance and mechanical communication between second substance communicating device 16 and first substance communicating device 12 will normally require a physical coupling. Data, power, illumination, thermal or acoustic communication may require a physical coupling or may occur through a contactless or wireless connection.

In one embodiment, a changed substance is communicated through connector component 18F. The substance may initially be a resource or a consumable and will have been changed by one of the substance communicating devices prior to being communicated to the other substance communicating device. A changed substance may be one whose properties have been changed by a chemical, thermal, electrical, or other type of process. For example a changed substance may be one that has been heated, cleaned, cooled, mixed with a consumable, or generally treated in such a way that it has at least one property with a different value.

As mentioned above, connector component 18E may include a power connector. A power connector may deliver power to a second substance communicating device 16 or it may deliver power to smart process control apparatus 14. The power may be conventional AC at 110 V, DC at 12 V, or another type or amount, such as the power that is transmitted by a USB connection. In some cases, a connector component may function as both a data and a power source.

Second substance communicating device 16 has an internal source 26' and/or an external source 26" of a consulable 24. If second substance communicating device 16 has the optional process control apparatus 28, as shown in FIG. 2, the process control apparatus 28 may be used for controlling the dispensing or communication of consulable 24 from source 26' or 26".

Second substance communicating device 16 may have components of system software architecture and electronics 15 shown in FIG. 1. For example, as shown in FIG. 2, second substance communicating device 16 may further comprise electronics 30 configured for communication through connector component 20C with an accessory device such as a consumables reader 36, or through service connector system 18 with smart process control apparatus 14 of first substance communicating device 12 (see FIG. 1). Electronics 30 may affect the operation of the first substance communicating device 12 by communicating with appliance smart process control apparatus 14 when second substance communicating device 16 is in communication with the first substance communicating device 12 through connector component 18C. Electronics 30 may be configured to deliver a cycle of operation to first substance communicating device 12. Additionally, electronics 30 may be coupled to the process control apparatus 28 of the second substance communicating device 16 to provide additional functionality to substance handling system 10.

Alternatively, electronics 30 may communicate with portions of system software architecture and electronics 15 in the first substance communicating device for the purposes of observing the cycle of operation and modifying the cycle of operation. Electronics 30 may observe the cycle of operation using an appropriate data collection scheme, such as those disclosed in PCT Application Serial Number US2006/022430, filed 8 Jun. 2006, entitled "Software Architecture System and Method of Communication with, and Management of, at least One Component within a Household Appliance," supported by software of the system software architecture and electronics 15. These data collection schemes include, but are not limited to: requesting data from system software architecture and electronics 15, such as data stored in a data storage device 34 or data processed by the software architecture received from the first substance communicating device 12 such as unsolicited events from the cycle of operation; and creating new events that may be received by communicating with a software architecture having a data acquisition (DAQ), not shown, as disclosed and defined in the above referenced PCT patent application and specifying the events to the DAQ for creation by the DAQ.

In addition, electronics 30 may alter a cycle of operation of one of the devices 12, 16 in response to the observations, such as in the manner described in the above referenced PCT patent application. In a first embodiment, electronics 30 may alter the cycle of operation by requesting software in the system software architecture and electronics 15, so that the smart process control apparatus 14 will enter an alternate operating mode enabling electronics 30 to directly control, partially or wholly, the cycle of operation. In a second embodiment, electronics 30 may alter the cycle of operation by making specific requests to system software architecture and electronics 15. In a third embodiment, the electronics may selectively alter the cycle structure using any of the techniques described herein. Electronics 30 may include a controller 32 and software architecture, not shown, similar to system software architecture and electronics 15 of first substance communicating device 12 and/or a software architecture driver (not shown). Electronics 30 may be powered by second substance communicating device 16 or via connection to the first substance communicating device 12. Electronics 30 may further comprise a client 40. Client 40 may comprise a plurality of arbitrary software components, system software architecture and electronics 15, not shown, an instance of system software architecture and electronics 15, a converter, and any other software and data storage and data access functionality.

It will be appreciated that some or all of the above described components of the electronics 30 may alternatively reside in the first substance communicating device 12 in any accessory or other device in data communication with the second substance communicating device.

The second substance communicating device 16 may also have a consumable reader 36, coupled to second substance communicating device 16 by connector component 20C. In this case, consumable reader 36 is communicatively coupled to the controller 32 and to system software architecture and electronics 15. This enables information about consulable 24 and/or about second substance communicating device 16 to be read from a source of information and transferred into the memory of controller 32 or into the memory of at least one control board within the smart process control apparatus 14 wherein the transferring may be accomplished using system software architecture and electronics 15.

Second substance communicating device 16 may have at least one sensor 38 to sense one or more attributes of a consulable 24 and/or its source 26' or 26". Attributes may include, but are not limited to, amount, brand, type, composition, structural form, expiration date, dispensing properties, nutritional information, temperature, pressure, and concentration. To store and inventory such data, second substance communicating device 16 may utilize controller 32. Such information or data may also be conveyed to and/or presented at a user interface in second substance communicating device 16 or first substance communicating device 12.

Process control apparatus 28 of second substance communicating device 16 may be configured to detect functionalities of first substance communicating device 12, modify functionalities of first substance communicating device 12, be controlled by first substance communicating device 12, be controlled by electronics 30, or otherwise exchange data with the smart process control apparatus 14 of first substance communicating device 12 either directly through one or more coupling points of service connector system 18 or indirectly through electronics 30 coupled to the first substance communicating device 12 through connector component 18C. Process control apparatus 28 may be used for the transmission, dispensing, supplying, or usage of at least one consulable 24 by responding to control signals resulting in the actuating of a mechanical part, such as a valve, conduit, solenoid, sensor, actuator, spring, transmission, motor, or gear, not shown. Additionally, process control apparatus 28 may be configured to modify properties of one or more consumables or resources such as temperature or a chemical property. For example, temperature could be raised by actuating a heater, and chemical properties might be changed by controlling a mixture of at least two consumables and/or resources by using a motor and an auger. Additional auxiliary functionalities not directly related to consumables 24 may be enabled by process control apparatus 28. Process control apparatus 28 may optionally include a mechanism to affect the use of a resource, such as an actuator for a valve.

Second substance communicating device 16 may receive resources from first substance communicating device 12, act on the resources, and return the modified resources to the appliance. For example, in a washing machine or dishwasher, second substance communicating device 16 may receive water from first substance communicating device 12 and return that water to first substance communicating device 12 as grey water or as water mixed with detergent. In this instance, detergent would be consulable 24. Second substance communicating device 16 may thus export modified consumables 24 which have either been operated on by second substance communicating device 16 or that have been operated on by the introduction of at least one resource. Second substance communicating device 16 may also dispense consulable 24 directly to first substance communicating device 12.

Client 40 in electronics 30 may contain a data set linking the model of first substance communicating device 12 or some other functional identifier such as a class identification, application programming interface (API) identification, type, and/or version to the consumables 24 that second substance communicating device 16 may contain. The data set may further link any of these attributes to a plurality of cycles of operation for first substance communicating device 12. The data set may also link cycle modification or cycle operation data or cycle structure data or data for response to a query message to various combinations of appliances 12, consumables 24, and selected cycles. The data set may alternatively be in first substance communicating device 12. The data in the data set may be modified by a message sent by one of the constituents of the substance handling system 10, such as second substance communicating device 16, consulable 24, consumable reader 36, or accessory devices 22, 23, 25.

Figure 3:
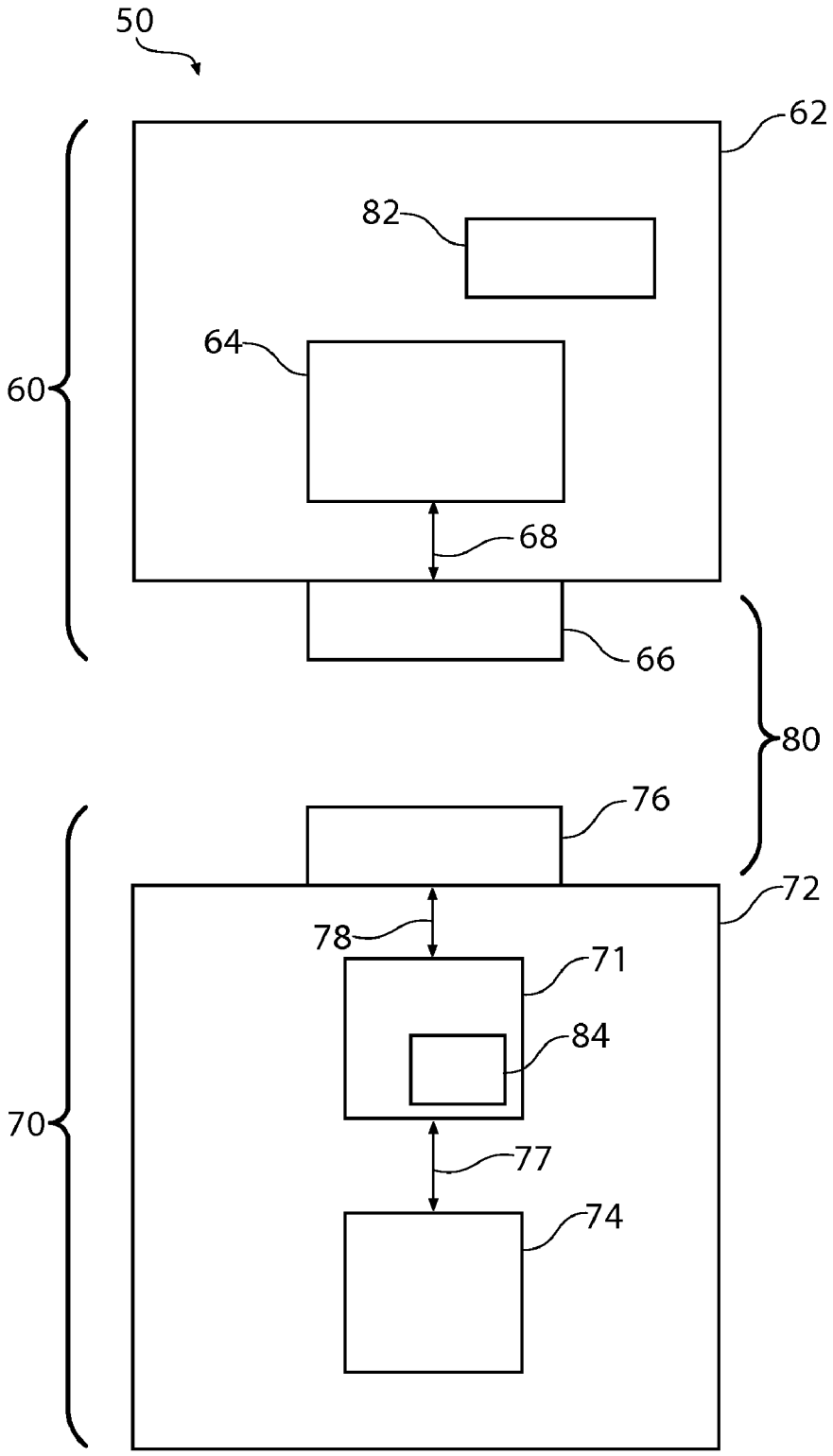
FIG. 3 is a schematic illustration showing a connector component.

Turning now to FIG. 3, a connector component 50, providing one possible configuration for at least one of connector component 18A-18F (see FIG. 2) or 20A-20C (see FIG. 1) is schematically illustrated. A first substance communicating device 60 is connectable to a second substance communicating device 70 for selectively communicating a substance therebetween. First substance communicating device 60 may comprise a host 62 having a substance consumer 64 connected to a first substance service connector component, such as a plug 66, by means of a substance line 68. Second substance communicating device 70 may comprise an accessory device 72 comprising a substance holder having a substance provider 74 connected to a second substance service connector component, such as a receptacle 76, by substance lines 77 and 78 and regulated by a switching valve 71.

A substance communication service connector system 80 includes plug 66 and receptacle 76, which are selectively interengageable. A proximity target 82 associated with host 62 and a proximity switch 84 associated with accessory device 72 and including a proximity sensor, not shown, for detecting the presence of proximity target 82. Proximity switch 84 is operable to selectively activate switching valve 71 when plug 66 and receptacle 76 are engaged, as determined by the proximity sensor, to permit the flow of the substance from substance provider 74 to receptacle 76, which may then be subsequently transferred along substance line 68 to substance consumer 64.

It will be appreciated that while accessory device 72 is illustrated as including a substance provider and host 62 is illustrated as including a substance consumer, host 62 may alternatively or additionally include a substance provider and accessory device 72 may alternatively or additionally include a substance consumer. It will further be appreciated that while plug 66 is illustrated as being associated with substance consumer 64 and receptacle 76 is illustrated as being associated with substance provider 74, it is contemplated that plug 66 and receptacle 76 may be male or female connector components so long as the components are capable of interengaging to permit the transfer of substance therebetween.

Figure 4:
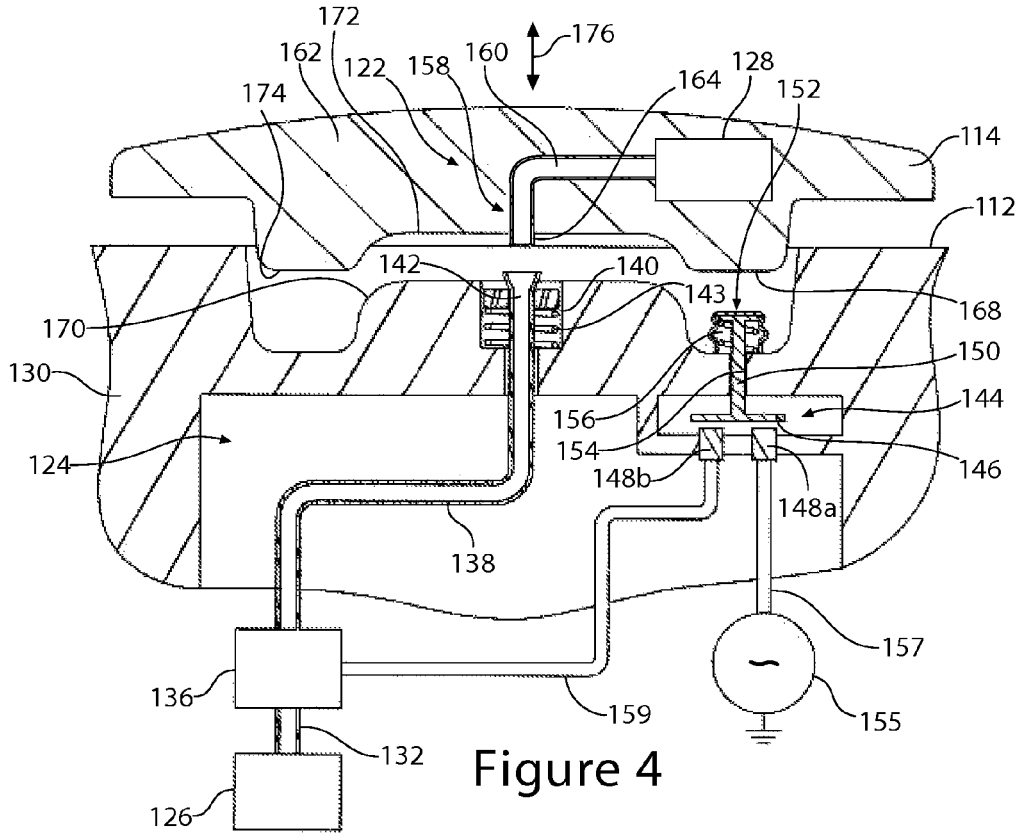
FIG. 4 is a partial cross-sectional view of a mechanically energized substance communication coupling system showing a first substance communication device positioned for engagement with a second substance communication device.
Figure 5:
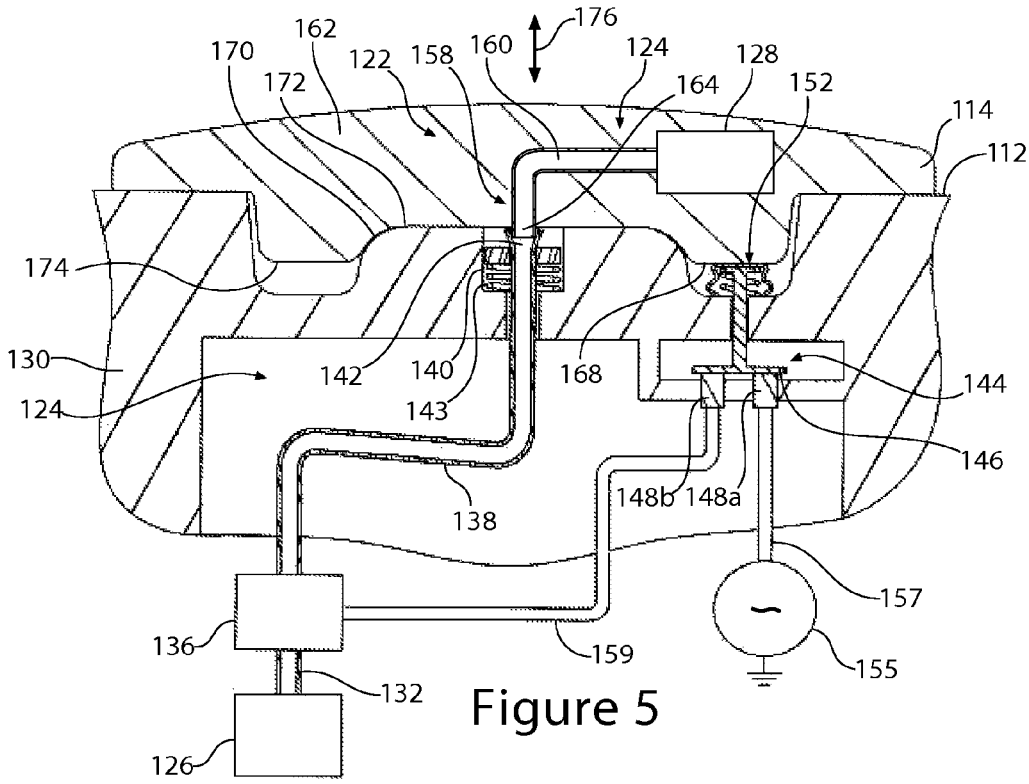
FIG. 5 is a partial cross-sectional view similar to FIG. 4 showing the first substance communication device engaged with the second substance communication device.

Referring to FIGS. 4 and 5, a more specific example of a substance communicating system is illustrated and includes a first substance communicating device 112 having a first substance connector component 124 and a second substance communicating device 114 having a second substance connector component 122. In the example illustrated, one of the substance communicating devices may, for example, be a host appliance and the other substance communicating device may be an accessory. One of the substance communicating devices may be a substance provider and the other may be a substance consumer.

First substance connector component 124 and second substance connector component 122 have complementary configurations that enable the substance connector components to be coupled to one another, thereby establishing a substance pathway over which desired substances may be transferred between first substance communicating device 112 and second substance communicating device 114. Together, first substance connector component 124 and second substance connector component 122 comprise a substance communication connector. Substance connector components 122 and 124 may be integrally formed with second substance communicating device 114 and first substance communicating device 112, respectively, or may be an add-on devices.

First substance connector component 124 may be enclosed within a housing 130. Housing 130 may be an integral part of first substance communicating device 112 or may be a separate component. For purposes of discussion, housing 130 is illustrated as an integral part of first substance communicating device 112, and more particularly as part of the door of a refrigerator. When configured as an add-on device, first substance connector component 124 may also function as an adapter to enable a host and a device having dissimilar substance communication coupling systems to be indirectly coupled to one another. First substance connector component 124 may be removable or non-removable from first substance communicating device 112. First substance connector component 124 may be configured to transfer or receive a single substance or multiple substances.

First substance communicating device 112 may be associated with a substance provider 126 for selectively providing a substance to first substance connector component 124 for delivery to second substance connector component 122. Second substance communicating device 114 may similarly be provided with a substance consuming device 128 capable of using the substance delivered to second substance connector component 122.

First substance connector component 124 may include a first substance line 132 operably connected to substance provider 126. First substance line 132 is operable for facilitating transfer of a substance from substance provider 126 for delivery to second substance communicating device 114. First substance line 132 has one end operably connected to substance provider 126 and an opposite end operably connected to a flow regulating device, such as a substance flow regulating component 136, which may be a pump.

First substance connector component 124 may further include a second substance line 138 having one end operably connected to substance flow regulating component 136 and an opposite end to a receptacle 140. Receptacle 140 extends through housing 130 so as to be accessible from outside the housing 130. An exposed end 142 of receptacle 140 operably engages a corresponding plug 158 of second substance communicating device 114, described below, when the substance consumer is coupled to first substance communicating device 112. First substance communicating device 112 may further be provided with a biasing member 143 for outwardly biasing exposed end 142 of receptacle 140 from housing 130 towards second substance communicating device 114.

It will be appreciated that in addition to a line for defining a pathway for substance, receptacle 140 may be configured to provide additional features for communicating other services such as one or more electrical contacts, a fiber optic cable, or a power take-off.

For purposes of discussion, first and second substance lines 132 and 138 are illustrated generically as tube-like structures. The generically illustrated configuration is not intended to depict any particular configuration, but rather schematically represents a variety of potentially different configurations. In practice, the actual configuration will likely vary depending on, at least in part, the type of substance being transferred, packaging requirements, and manufacturing considerations, to name a few. For example, a conveyor or other system may be incorporated for delivering capsulated or powdered substances.

First substance connector component 124 may include a proximity switch 144 that may be selectively actuated to open substance flow regulating component 136 to establish a substance pathway between substance provider 126 and the receptacle 140 when second substance communicating device 114 is coupled to first substance communicating device 112. Switch 144 may include a switch plate 146 that is movable between an open position, shown in FIG. 4, and a closed position, shown in FIG. 5, against contacts **148*a* and 148*b* to enable a substance to be selectively transferred between first substance line 132 and second substance line 138 by selectively completing a circuit between contacts 148*a* and 148*b* to deliver power to substance flow regulating component 136. Switch plate 146 is generally disposed in the open position when second substance communicating device 114 is decoupled from first substance communicating device 112**.

The operation of proximity switch 144, and more particularly, switch plate 146, may be controlled by a mechanically-actuated plunger 150. Plunger 150 may include a proximity sensor 152 adapted to activate proximity switch 144 to selectively permit the flow of a substance from first substance line 132 to second substance line 138 upon engaging an appropriate proximity target, described shortly, provided with second substance communicating device 114. Plunger 150 slidably engages an aperture 154 in housing 130. One end of plunger 150 may be operably connected to switch plate 146 and an opposite end extends out from housing 130 and is engageable with a proximity target associated with second substance communicating device 114. Depressing plunger 150 causes switch plate 146 to be displaced toward and into engagement with first and second contacts 148*a* and 148*b*, thereby allowing a substance to pass from second substance line 132 to second substance line 138. A biasing member 156 may be provided to urge switch plate 146 away from first and second contacts 148*a* and 148*b* when the proximity target is not detected by proximity sensor 152.

Proximity switch 144 may have any of a variety of alternative configurations depending on the requirements of the particular application. Proximity switch 144 may be configured to selectively transfer an appropriate control signal for activating substance flow regulating component 136 in response to a proximity sensor 152 detecting the presence of a proximity target associated with second substance communicating device 114. Proximity switch 144 may be operably connected to signal source or power supply 155, such as a source of electrical power or pressurized fluid, by means of a first control signal line 157. Signal source or power supply 155 may be configured to generate an appropriate control signal for activating substance flow regulating component 136. The control signal may include an electrical signal, an acoustic or electromagnetic wave, a pneumatic signal, an optical signal, a magnetic flux signal, a radio frequency signal, an infrared (IR) signal, a hydraulic signal, a physical displacement of a linking member, as well as others. A second control signal line 159 operably connects proximity switch 144 to substance flow regulating component 136 for delivery of the control signal.

Second substance connector component 122 may be integrally formed with second substance communicating device 114 or may be an add-on component. For purposes of discussion, second substance connector component 122 is shown integrally formed with second substance communicating device 114. When configured as an add-on component, second substance connector component 122 may also function as an adapter to enable a host and an accessory device having dissimilar substance communication coupling systems to be indirectly coupled to one another. Second substance connector component 122 may be removable or non-removable from substance communicating device 114. Second substance connector component 122 may be configured to transfer or receive a single substance or multiple substances.

A substance consuming device 128 is associated with second substance communicating device 114 and may be operably connected to a plug 158 by means of a substance line 160. Plug 158 extends through a housing 162 of second substance communicating device 114 so as to be accessible from outside the housing 162. An exposed end 164 of plug 158 operably engages the exposed end 142 of the receptacle 140 of first substance communicating device 112 when second substance communicating device 114 is coupled to first substance communicating device 112. It will be appreciated that plug 158 may be configured as one or more tubes or another type of interface depending on the type of substance being consumed by substance consuming device 128.

Second substance communicating device 114 may further be provided with a biasing member (not shown) in addition to or instead of biasing member 143 of first substance communicating device 112, for outwardly biasing plug 158 from housing 162 of second substance communicating device 114 towards engagement with the receptacle 140.

Second substance communicating device 114 may further be provided with a proximity target 168 chosen for cooperation with the proximity sensor 152.

Similar to substance lines 132 and 138, substance line 160 is also illustrated generically as a tube-like structure. The generically illustrated configuration is not intended to depict any particular configuration, but rather schematically represents a variety of potentially different configurations that may vary depending on the type of substance being transferred, as well as other design considerations. In practice, the actual configuration may vary depending on, at least in part, the type of substance being transferred, packaging requirements, and manufacturing considerations, to name a few.

First substance connector component 124 and second substance connector component 122 may include various features to facilitate coupling of second substance communicating device 114 to first substance communicating device 112. For example, first substance connector component 124 may include a raised boss 170 that may engage a corresponding recess 172 of second substance connector component 122. A raised ridge 174 at least partially defines an outer circumference of recess 172. Alignment features such as boss 170 and recess 172 may assist in positioning second substance connector component 122 relative to first substance connector component 124 prior to engagement, and may also function to minimizing lateral movement of second substance communicating device 114 relative to first substance communicating device 112 when second substance connector component 122 is coupled to first substance connector component 124. It shall be appreciated, however, that the illustrated configuration is merely one example of the type of features that may be incorporated into first substance connector component 124 and second substance connector component 122 to aide alignment and coupling of second substance communicating device 114 to first substance communicating device 112. In practice, other configurations may also be employed to accommodate various design considerations of a particular application.

The process of coupling and decoupling second substance communicating device 114 with first substance communicating device 112 will now be described. Coupling of second substance communicating device 114 to first substance communicating device 112 may be accomplished by positioning second substance communicating device 114 adjacent first substance communicating device 112 in such a manner that second substance connector component 122 is generally aligned with first substance connector component 124, as shown in FIG. 4. Second substance connector component 122 and first substance connector component 124 may be coupled together by generally moving second substance communicating device 114 toward first substance communicating device 112 along a path indicated by arrow 176 until the two members are fully seated, as shown in FIG. 5. With second substance connector component 122 fully engaging first substance connector component 124, exposed end 164 of plug 158 operably engages exposed end 142 of receptacle 140. The process of coupling second substance connector component 122 to first substance connector component 124 causes proximity target 168 to engage proximity sensor 152 of proximity switch 144. Engaging second substance connector component 122 with substance communication coupling system 124 depresses plunger 150 of proximity switch 144 so as to engage switch plate 146 with first and second contacts 148*a* and 148*b*. Depressing proximity switch 144 operably couples first control signal line 157 to second control signal line 159, thereby allowing the control signal to be transmitted from signal source or power supply 155 to substance flow regulating component 136. The control signal activates the substance flow regulating component 136 and allows the substance to pass from substance provider 126 to substance consuming device 128.

It should be noted that substance flow regulating component 136 is intended to selectively permit and inhibit flow of substance from the substance supply to the exposed end 142 of the receptacle 140 based on the presence of the proximity target 168, and that other valves and controls may be provided to further regulate the control of substance based on the needs of the user of the system.

Second substance communicating device 114 may be decoupled from first substance communicating device 112 by reversing the previously described process for coupling the two devices together. Disengaging second substance connector component 122 from first substance connector component 124 releases plunger 150 and disengages switch plate 146 from first and second contacts 148*a* and 148*b*, thereby interrupting the flow of substance between second substance communicating device 114 and first substance communicating device 112. Decoupling second substance communicating device 114 from first substance communicating device 112 disengages proximity switch 144 and interrupts the transmission of the control signal to substance flow regulating component 136, thereby deactivating the substance switch.

Figure 6:
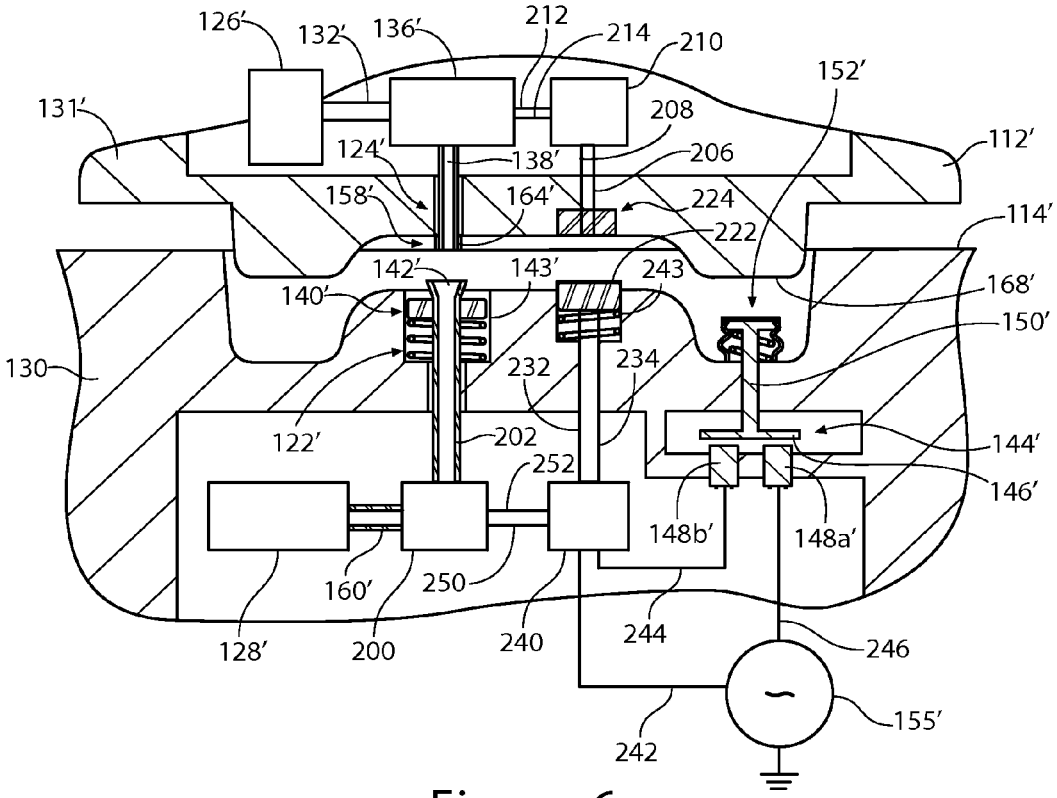
FIG. 6 is a partial cross-sectional view of an alternate mechanically energized substance communication coupling system showing a first substance communication device positioned for engagement with a second substance communication device.

Referring to FIG. 6 an alternative substance communicating system is illustrated, and includes a first substance communicating device 112' and a second substance communicating device 114'. First substance communicating device 112' and second substance communicating device 114' each have two connector components. A proximity sensor 152' and a signal source or power supply 155' are in the second substance communicating device 114', whereas the proximity sensor 152 and signal source or power supply 155 were in the first substance communicating device 112 in the previously described embodiment for FIGS. 4 and 5. This configuration may be used, for example, when the second substance communicating device 114' is an appliance that is connected to a residential power supply and the first substance communicating device 112' is an accessory device without an independent source of power.

To avoid confusion, please note that the second substance communicating device 114' is a substance consumer and is illustrated below the substance communicating device 112', which is a substance provider, in FIG. 6, which is the reverse of the configuration shown in FIGS. 4 and 5.

First substance communicating device 112' has a substance provider 126' connected by a first substance line 132' to a first flow regulating device 136', such as a switching valve or a pump, shown only schematically as a box. The first flow regulating device 136' is connected to a second substance line 138' leading to first substance connector component 124'. In the exemplary device shown in FIG. 6, first substance connector component 124' comprises a plug 158' comprising an exposed end 164' of the substance line 138'.

Second substance communicating device 114' has a substance consuming device 128' connected by a substance line 160' to a second flow regulating device 200, such as switching valve or a pump, connected in turn to a substance line 202 leading to second substance connector component 122'. In the exemplary device shown in FIG. 6, second substance connector component 122' comprises a receptacle 140' formed at an exposed end 142' of substance line 202. Exposed end 142' of substance line 202 of second substance communicating device 114' is engageable with an exposed end 164' of substance line 138' of a first substance communicating device 112' to permit the communication of substance therebetween.

Second substance communicating device 114' has a proximity switch 144' having a plunger 150' with a switch plate 146' movable between an open position, as shown, and a closed position, not shown, against contacts 148*a'* and 148*b'*. First substance communicating device 112' has a proximity target 168' engageable with plunger 150' to selectively close switch 144'. Each of these components is similar to similarly named and numbered components described above with reference to FIGS. 4 and 5, except as described below.

First substance communicating device 112' has a first substance connector component 124' and a first electromagnetic substance connector component 224. Second substance communicating device 114' has a second substance connector component 122' and a second electromagnetic connector component 222. First substance connector component 124' and second substance connector component 122' have complementary configurations that enable the substance connector components to be coupled to one another, thereby establishing a substance pathway over which desired substances may be transferred between first substance communicating device 112' and second substance communicating device 114' and are similar to those described above with reference to FIGS. 4 and 5.

First electromagnetic connector component 224 and second electromagnetic connector system component 222 have complementary configurations that enable the electromagnetic connector components to be coupled to one another, thereby establishing a electrical pathway over which power or data may be transferred between first substance communicating device 112' and second substance communicating device 114'. It will be appreciated that wireless power or data may alternatively be communicated between the electromagnetic connector components. Together, first electromagnetic connector component 224 and second electromagnetic connector component 222 comprise an electromagnetic communication connector. First electromagnetic connector component 224 may be enclosed within housing 131' and may be removable or non-removable from first substance communicating device 112'. First electromagnetic connector component 224 may be configured to transfer or receive power, data or both. Second electromagnetic connector system component 222 may be provided with a biasing member 243 performing a function similar to biasing member 143' to facilitate a reliable connection with a first electromagnetic connector component 224.

First electromagnetic connector component 224 may be connected by electrical lines 206 and 208 to a control element 210. Control element 210 is connected by electrical lines 212 and 214 to first flow regulating device 136' to provide a controlling signal to flow regulating device 136'. Control element 210 may provide the controlling signal in response to signals from other components. Second electromagnetic connector component 222 may be connected by electrical lines 232 and 234 to a control element 240 selectively operable to provide the electromagnetic service to first electromagnetic connector component 224. Control element 240 is connected in series with proximity sensor 152' and signal source or power supply 155' by electrical lines 242, 244 and 246 such that control element 240 receives a signal when proximity sensor 152' is closed as a result of the coupling of first and second substance communicating devices 112' and 114'. Control element 240 may be connected by electrical lines 250 and 252 to second flow regulating device 200. Additionally, control element 240 may be connected to control element 210 or to first flow regulating device 136' for the operable control of the substance communication from substance provider 126'. In an alternate embodiment, electrical lines 244 and 242 might directly connect to the first flow regulating device 136' via intermediate connections to electromagnetic connector system components 222 and 224 providing a direct control signal from proximity switch 144' to the first flow regulating device 136'. Other configurations are possible such as having electrical lines 244 and 242 directly connect to second flow regulating device 200, thereby providing a direct control signal from proximity switch 144' to second flow regulating device 200.

Flow regulating device 136', which may be a normally closed valve requiring power to be opened or a pump requiring power to operate, acts to prevent the communication of substance from substance communicating device 112'. Similarly, normally open proximity switch 144' and control element 240 prevent the flow of power or data from the second substance communicating device 114'. When substance communicating device 114' is coupled to substance communicating device 112', proximity switch 144' is closed, permitting the flow of power to control element 240. Control element 240 may then selectively supply power or data to the substance communicating device 112' through connectors 222 and 224.

For some implementations, control element 240 may selectively operate second flow regulating device 200. It will be appreciated that, for some other implementations, control element 240 may be omitted and electrical line 232 may be connected to electrical line 242 and electrical line 234 may be connected to electrical line 244 such that power will be provided directly by signal source or power supply 155' to substance communicating device 112' when proximity switch 144' is closed by the coupling of substance communicating device 114' and substance communicating device 112'.

Power or data communicated from substance communicating device 114' is received by control element 210, which may then selectively operate first flow regulating device 136' to permit the communication of substance from substance provider 126' to substance communicating device 114'. Thus, the control of supply of substance is controlled indirectly by the action of proximity switch 144'.

For some implementations, control element 210 may be omitted and electrical lines 208 and 206 may be connected directly to first flow regulating device 136' to directly operate the flow regulating device upon the delivery of power or data from second substance communicating device 114'. If both control elements 210 and 240 are eliminated, then flow regulating device 136' is powered directly by signal source or power supply 155' upon the closing of proximity switch 144'.

Control elements 210 and 240 may be embodied in a plurality of designs and configurations. In one embodiment, either or both of control elements 210 and 240 may be relays with one or more contacts pairs for wiring auxiliary circuits, where the continuity of the circuit is determined by the state of the relay coil being either energized or de-energized. In a second embodiment, either or both of control elements 210 and 240 may be micro-processors with appropriate signal conditioning circuitry for electrically interfacing with other electrical components.

It will be appreciated that in where control elements 210 or 240 are used, these control elements form a part of the system software architecture and electronics 15 described above with reference to FIGS. 1 and 2, and may incorporate portions of process control apparatus 14 or 28.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A system comprising:

an appliance having a first substance service connector component, a substance provider, and a flow regulating device for regulating the flow of a substance from the substance provider;

a substance communicating device having a second substance service connector component operably engageable with the first substance service connector component, and a substance consumer connected to the second substance service connector component;

a service switch provided on the appliance, and selectively actuated to establish a substance pathway between the substance provider and the substance consumer, the service switch comprising:

a first terminal;

a second terminal coupled to the flow regulating device;

a switch plate that is moveable between an open position, in which the first terminal is not connected to the second terminal, and a closed position, in which the first terminal is connected to the second terminal; and a contact proximity sensor operably connected to the switch plate; and a contact proximity target provided on the substance communicating device for engagement with the proximity sensor;

wherein the switch plate moves from the open position to the closed position to activate the flow regulating device to permit the flow of the substance along the substance pathway in response to the contact proximity target engaging the contact proximity sensor; and wherein the contact proximity target is configured to engage the contact proximity sensor when the second substance service connector component is engaged with the first substance service connector component.

2. The system according to claim 1, wherein the service switch is configured to selectively permit the communication of an electromagnetic service between the substance communicating device and the appliance.

3. The system according to claim 1, wherein the substance consumer comprises at least one of a detergent dispenser, a drink dispenser, a bottle, a jug, and an accessory.

4. The system according to claim 1, wherein the substance communicating device comprises one of a filter, a water filter, a refrigerator water filter, a dispenser, a chemical dispenser, a dispenser for a washing machine, a dispenser for a dryer, a dispenser for a dishwasher, a dispenser for water, a dispenser for ice, a dispenser of liquid, and a dispenser of a drink.

5. The system according to claim 1, wherein the substance communicating device comprises an appliance.

6. The system according to claim 1, wherein the substance communicating device comprises:

a main body;

and a substance line having a first end coupled with the substance consumer and a second end coupled with the second substance service connector component.

7. The system according to claim 1 and further comprising:

a control element associated with the first substance service connector component and configured to selectively permit the communication of the substance between the substance communicating device and the appliance; and an actuator operably associated with the second substance service connector component, the actuator being configured to actuate the control element when the first and second substance service connector components are engaged to selectively permit the communication of the substance between the substance communicating device and the appliance.

8. The system according to claim 1, wherein the substance provider comprises a consumable holder.

9. The system according to claim 1, wherein the appliance comprises a housing and the first substance service connector component comprises a biasing member for biasing the first substance service connector component away from the housing.

10. The system according to claim 1, wherein the service switch further comprises a biasing member for urging the switch plate toward the open position.

11. The system according to claim 1, wherein the flow regulating device comprises at least one of a pump, a valve, a fan, a conveyor, a tube with an adjustable diameter, and an elevator.

12. The system according to claim 1, wherein the appliance comprises at least one of a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus.

13. The system according to claim 1 and further comprising a first electromagnetic service connector component provided on the appliance and a second electromagnetic service connector component provided on the substance communicating device and operably engageable with the first electromagnetic service connector component to permit the communication of an electromagnetic service between the first and second electromagnetic service connector components.

14. The system according to claim 13, wherein the second electromagnetic service connector component is configured to engage the first electromagnetic service connector component when the first and second substance service connector components are engaged to selectively permit the contemporaneous communication of the substance and the electromagnetic service between the substance communicating device and the appliance.

15. The system according to claim 13, wherein the second substance service connector component comprises the second electromagnetic service connector component.

16. The system according to claim 13, wherein the flow regulating device selectively permits the communication of the substance between the first and second substance service connector components in response to the communication of an electromagnetic service between the first and second electromagnetic service connector components.

17. The system according to claim 1, wherein the appliance comprises a first housing, and a portion of the contact proximity sensor is exterior of the first housing.

18. The system according to claim 17, wherein the appliance comprises a recess provided in the first housing, wherein at least one of the first substance service connector component and the contact proximity sensor is provided in the recess.

19. The system according to claim 18, wherein the substance communicating device comprises a second housing and a raised boss provided on the second housing, wherein at least one of the second substance service connector component and the contact proximity target is provided on the raised boss and the raised boss is configured to be at least partially received in the recess.

20. The system according to claim 1, wherein the contact proximity sensor is operably coupled to the switch plate by a physical link.

21. The system according to claim 20, wherein the physical link comprises a moveable plunger connected to the switch plate.

22. A system comprising:

an appliance having a first substance service connector component;

a substance communicating device having a second substance service connector component operably engageable with the first substance service connector component;

a substance provider fluidly coupled with one of the first and second substance service connector components;

a substance consumer fluidly coupled with the other of the first and second substance service connector components;

a flow regulating device provided on one of the appliance and the substance communicating device for regulating the flow of a substance from the substance provider;

a service switch provided on one of the appliance and the substance communicating device, and selectively actuated to establish a substance pathway between the substance provider and the substance consumer, the service switch comprising:

a first terminal;

a second terminal;

a switch plate that is moveable between an open position, in which the first terminal is not connected to the second terminal, and a closed position, in which the first terminal is connected to the second terminal; and a contact proximity sensor operably connected to the switch plate; and a contact proximity target provided on the other of the appliance and the substance communicating device for engagement with the proximity sensor;

wherein the switch plate moves from the open position to the closed position to activate the flow regulating device to permit the flow of the substance along the substance pathway in response to the contact proximity target engaging the contact proximity sensor; and wherein the contact proximity target is configured to engage the contact proximity sensor when the second substance service connector component is engaged with the first substance service connector component.

23. The system according to claim 22 and further comprising:

a control element operably associated with one of the first and second substance service connector components, and configured to selectively permit the communication of a service between the substance communicating device and the appliance; and an actuator associated with the other of the first and second substance service connector components, and configured to selectively engage the control element when the first and second substance service connectors are engaged to permit the communication of a service between the substance communicating device and the appliance.

24. The system according to claim 22, wherein the first substance service connector component further comprises a first electromagnetic service connector component, and the second substance service connector component further comprises a second electromagnetic service connector component, wherein the second electromagnetic service connector component is operably engageable with the first electromagnetic service connector component to permit the communication of an electromagnetic service between the appliance and the substance communicating device.

25. The system according to claim 22, wherein the substance communicating device comprises one of a filter, a water filter, a refrigerator water filter, a dispenser, a chemical dispenser, a dispenser for a washing machine, a dispenser for a dryer, a dispenser for a dishwasher, a dispenser for water, a dispenser for ice, a dispenser of liquid, and a dispenser of a drink.

26. The system according to claim 22, wherein the appliance comprises a housing and the first substance service connector component comprises a biasing member for biasing the first substance service connector component away from the housing.

27. The system according to claim 22, wherein the service switch further comprises a biasing member for urging the switch plate toward the open position.

28. The system according to claim 22, wherein the flow regulating device comprises at least one of a pump, a valve, a fan, a conveyor, a tube with an adjustable diameter, and an elevator.

29. The system according to claim 22, wherein the appliance comprises at least one of a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus.

30. The system according to claim 22, and further comprising a signal source coupled to the first terminal and configured to generate a control signal which activates the flow regulating device, wherein the switch plate moves from the open position to the closed position to transmit the control signal to activate the flow regulating device in response to the proximity target engaging the proximity sensor.

31. The system according to claim 22, and further comprising a second flow regulating device provided on the other of the appliance and the substance communicating device for regulating the flow of a substance from the substance provider.

32. The system according to claim 22 and further comprising:

a substance line extending from at least one of the first and second substance service connector components and the flow regulating device;

wherein the service switch comprises a control element for controlling the flow regulating device.

33. The system according to claim 32, wherein the appliance further comprises a first electromagnetic service connector component and the substance communicating device further comprises a second electromagnetic service connector component engageable with the first electromagnetic service connector component, wherein the service switch selectively permits the communication of electromagnetic service between the first and second electromagnetic service connector components and the control element is activated when electromagnetic service is communicated between the first and second electromagnetic service connector components.

34. The system according to claim 22, wherein the service switch is further configured to selectively permit the communication of at least one other service between the substance communicating device and the appliance.

35. The system according to claim 34, wherein the at least one other service comprises an electrical service.

36. The system according to claim 22, wherein the contact proximity sensor is operably coupled to the switch plate by a physical link.

37. The system according to claim 36, wherein the physical link comprises a moveable plunger connected to the switch plate.

38. The system according to claim 22 and further comprising a first electromagnetic service connector component provided on the appliance and a second electromagnetic service connector component provided on the substance communicating device and operably engageable with the first electromagnetic service connector component to permit the communication of an electromagnetic service between the first and second electromagnetic service connector components.

39. The system according to claim 38, wherein the flow regulating device selectively permits the communication of the substance in response to the communication of an electromagnetic service between the first and second electromagnetic service connector components.

* * * * *